US005265453A

United States Patent [19]

Konii et al.

[11] Patent Number: 5,265,453

[45] Date of Patent: Nov. 30, 1993

[54] CYLINDER LOCK

[75] Inventors: Katsuji Konii; Takeshi Fukasawa, both of Yokohama, Japan

[73] Assignee: Alpha Corporation, Kanagawa, Japan

[21] Appl. No.: 798,164

[22] Filed: Nov. 26, 1991

[30] Foreign Application Priority Data

Nov. 30, 1990 [JP] Japan ..... 2-330274
Sep. 27, 1991 [JP] Japan ..... 3-249800

[51] Int. Cl.[5] ..... E05B 17/04

[52] U.S. Cl. ..... 70/379 R; 70/360; 70/380

[58] Field of Search ..... 70/356, 360, 367, 369, 70/371, 379 R-380, 416, 422

[56] References Cited

U.S. PATENT DOCUMENTS

| | | | |
|---|---|---|---|
| 3,686,906 | 8/1972 | Watkins et al. | 70/360 X |
| 4,512,166 | 4/1985 | Dunphy et al. | 70/369 X |
| 4,633,689 | 1/1987 | Wolniak et al. | 70/379 R |
| 4,759,204 | 7/1988 | Neyret | 70/360 |
| 4,773,240 | 9/1988 | Foshee | 70/380 X |
| 4,903,512 | 2/1990 | Leroy et al. | 70/360 X |
| 4,936,895 | 6/1990 | Leclerc et al. | 70/380 |
| 5,044,183 | 9/1991 | Neyret | 70/380 X |
| 5,070,716 | 12/1991 | Whorlow | 70/380 X |

FOREIGN PATENT DOCUMENTS 1808633 6/1970 Fed. Rep. of Germany ..... 70/369

*Primary Examiner*—Peter M. Cuomo
*Assistant Examiner*—Suzanne L. Dino
*Attorney, Agent, or Firm*—Bachman & LaPointe

[57] ABSTRACT

A cylinder lock is disclosed having significant resistance to damage or tampering. The cylinder lock comprises an axial cam provided on the key cylinder; a rotator which may be engaged with the sleeve and be in contact with the axial cam of the key cylinder; a stopper positioned adjacent to the rotator and having a pair of lugs engageable with a recess of the casing; and an axial spring positioned between the stopper and a connector for resiliently urging the stopper toward the rotator. The rotator and stopper are axially moved by the axial cam of the key cylinder to release engagement of the rotator with the sleeve and also to release engagement of the stopper with the casing when the key cylinder is rotated independently of the sleeve by a correct key, thereby the rotator comes into engagement with the connector. By further rotating the key cylinder, the rotator, stopper and connector are rotated as a unit to a locked or unlocked position.

5 Claims, 18 Drawing Sheets

CYLINDER LOCK

FIELD OF THE INVENTION

The present invention relates, in general, to lock devices, and more particularly, to a cylinder lock that provides significant resistance to damage or tampering.

PRIOR ART

In a conventional cylinder lock, a key cylinder is rotatably mounted within a casing of the lock and a proper key may be inserted into and rotated with the key cylinder from locked to unlocked position. Tumblers are slidably disposed within slits formed in the key cylinder to engage with or disengage from a groove formed in the casing of the lock. In prior art cylinder locks, the tumblers engage with the groove in the casing to prevent unauthorized rotation of the key cylinder. Therefore, these locks might involve a risk of unallowed attempts to unlock or tamper by damaging the tumblers.

For example, as disclosed in U.S. Pat. No. 4,903,512, a free-turn type cylinder lock has been proposed wherein the key cylinder is designed to freely rotate against unallowed attempt to unlock when rotational force is applied to the key cylinder to destroy the tumblers. Such a cylinder lock includes a sleeve rotatably arranged in the casing, and a key cylinder supported within the sleeve for rotation. When a correct key is inserted into the key cylinder, the tumblers within the key cylinder are moved for disengagement from the groove formed in the sleeve, and thereby the key cylinder may be rotated independently of the sleeve so that a sliding ring engages with a lock-piece operating member to actuate the lock. If an incorrect key is inserted into the key cylinder, the sleeve is kept in the engaged condition by the tumblers with and rotates together with the key cylinder. This prevents rotation of the lock-piece operating member to inhibit unauthorized actuation of the lock.

If an incorrect key is inserted into the key cylinder of such free-turn type cylinder lock and then rotated, the key cylinder freely rotates with the incorrect key, and there will not be produced excessive force that might damage the tumblers and therefore significant resistance of the locks to damage is obtained. However, the lock disclosed in U.S. Pat. No. 4,903,512 has the disadvantage that the key cylinder cannot be rotated smoothly once an unauthorized key is inserted and rotated. A torsion coil spring is provided between the front plate and the key cylinder within the lock in order to automatically return the rotated key cylinder to its initial position. If an incorrect key is inserted into the key cylinder and rotated, the sleeve and the key cylinder are freely rotated together, then the torsion coil spring produces a resisting force. However, if they are rotated over a predetermined angle, the torsion coil spring restricts rotation of the key cylinder. This might pose a possibility that the torsion coil spring may be broken or damaged. However, without the torsion coil spring, the key cylinder will not be automatically returned to its initial position when the key cylinder is rotated with the correct key. Accordingly, the prior art lock has another disadvantage as it is difficult to utilize a lock of the structure of the '512 patent to actuate remote locking devices utilizing radio wave or infrared ray. Furthermore, due to axial movement of the sliding ring of the lock of the above U.S. Patent along the key cylinder, another shortcoming is that the lock is large in size and becomes complex in structure.

Accordingly, it is an object of the present invention to provide a novel cylinder lock with a key cylinder capable of freely rotating against an unauthorized attempt to unlock it.

SUMMARY OF THE INVENTION

The cylinder lock according to the present invention includes a casing; a sleeve rotatably disposed in the casing; a key cylinder disposed rotatably within the sleeve; tumblers slidably disposed within slits formed in the key cylinder for engagement with the sleeve; and a connector drivingly connected to a lock device. The cylinder lock further comprises an axial cam provided on the key cylinder; a rotator which may be engaged with the sleeve and be in contact with the axial cam of the key cylinder; a stopper positioned adjacent to the rotator and having at least a lug engageable with a recess of the casing; and an axial spring positioned between the stopper and the connector for resiliently urging the stopper toward the rotator. The rotator and stopper are moved axially by the axial cam of the key cylinder to release engagement of the rotator with the sleeve and also to release engagement of the stopper with the casing when the key cylinder is rotated by a correct key independently of the sleeve by a correct key, thereby causing the rotator to engage with the connector. The rotator, stopper and connector are rotated as a unit by further rotating the key cylinder to a locked or unlocked position. The cylinder lock further comprises a return spring disposed between the casing and connector.

In an another embodiment of the present invention, the cylinder lock comprises an axial cam provided on the key cylinder; a rotator engageable with the sleeve and in contact with the axial cam of the key cylinder; a stopper positioned adjacent to the rotator and having at least a lug engageable with a recess of the casing; an axial spring positioned between the stopper and a connector for resiliently urging the stopper toward the rotator; a pin radially slidably positioned within the key cylinder for engagement with a radial cam formed in the rotator; and a radial spring for resiliently urging the pin toward the radial cam.

When a correct key is inserted into the key cylinder, the tumblers in the key cylinder are moved away from the sleeve for disengagement to enable the key cylinder to rotate independently of the sleeve. Then, when the key cylinder is manually rotated, the axial cam in the key cylinder is also rotated. As the rotator is in engagement with the static sleeve at this time, it is axially and inwardly moved by the axial cam of the key cylinder. At the same time, the stopper also is axially inwardly moved together with the rotator against resilient force of the axial spring. At this time, the pin positioned with the key cylinder slides on the radial cam of the rotator against elastic force of the radial spring. Also, the sleeve is kept in the static condition relative to the casing.

During rotation of the key cylinder by the correct key, the rotator is fully moved in the axial direction away from the sleeve and comes into engagement with the connector. Then, the lugs of the stopper are disengaged from the notches of the casing, and the rotator is brought into engagement with the connector so that the key cylinder certainly is brought into engagement with the rotator and stopper. Then, the key cylinder is further rotated together with the rotator, stopper and connector as a unit against elastic force of the return spring to a locking or unlocking position of the connector.

When manual operation force is released from the key after the connector reaches the locking or unlocking position, elastic force of the return spring resiliently urges the connector, stopper and rotator to their initial positions in reverse direction, and in addition, elastic force of the radial spring resiliently urges the pins toward the radial cam of the rotator so that the key cylinder is automatically moved to its initial position.

When the key cylinder is rotated by use of an incorrect key, it is retained in the engaged condition with the sleeve by the tumblers and therefore is rotated with the sleeve. For that reason, the key cylinder can not be rotated relatively and independently of the sleeve, and the rotator can not be axially moved away from the sleeve. Therefore, the key cylinder can not be connected through the rotator with the connector for integral rotation.

The above-mentioned as well as other objects of the present invention will become apparent during the course of the following detailed description and appended claims.

DETAILED DESCRIPTION OF THE INVENTION

Referring to FIGS. 1 to 26, an embodiment of the present invention will be described.

Figure 1:
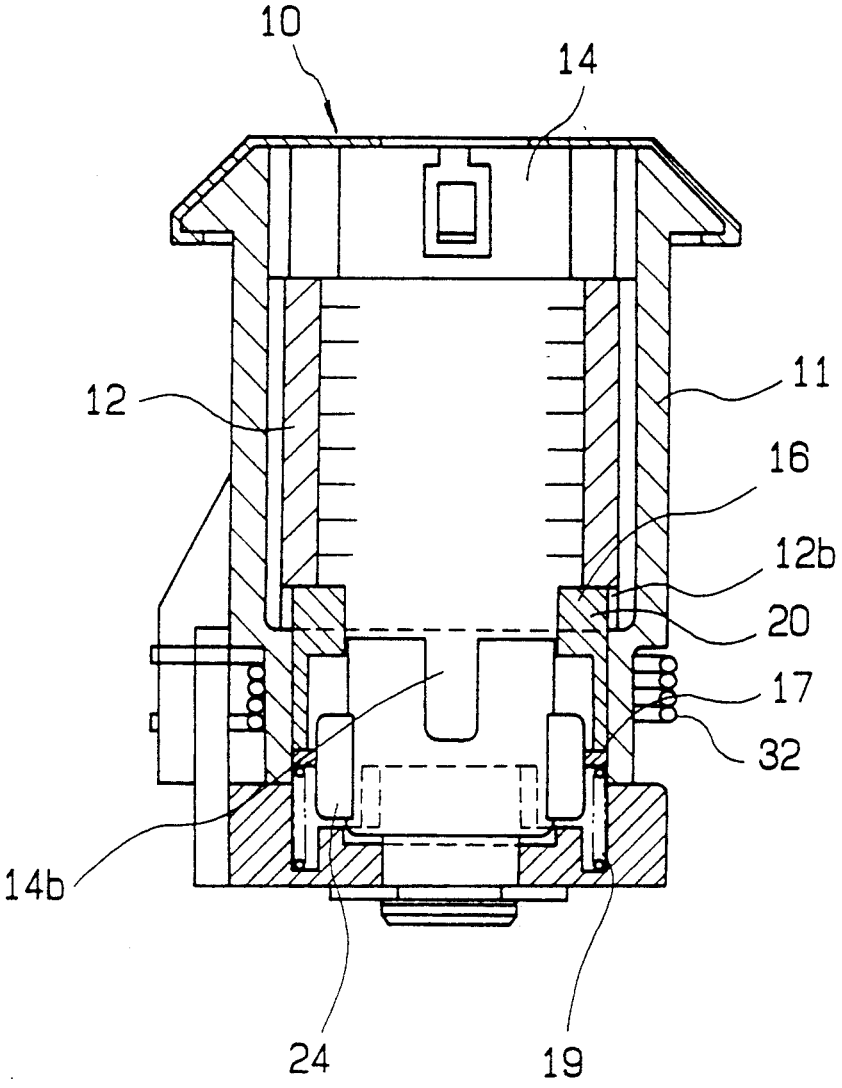
FIG. 1 is a cross-sectional view of a cylinder lock according to the present invention.
Figure 2:
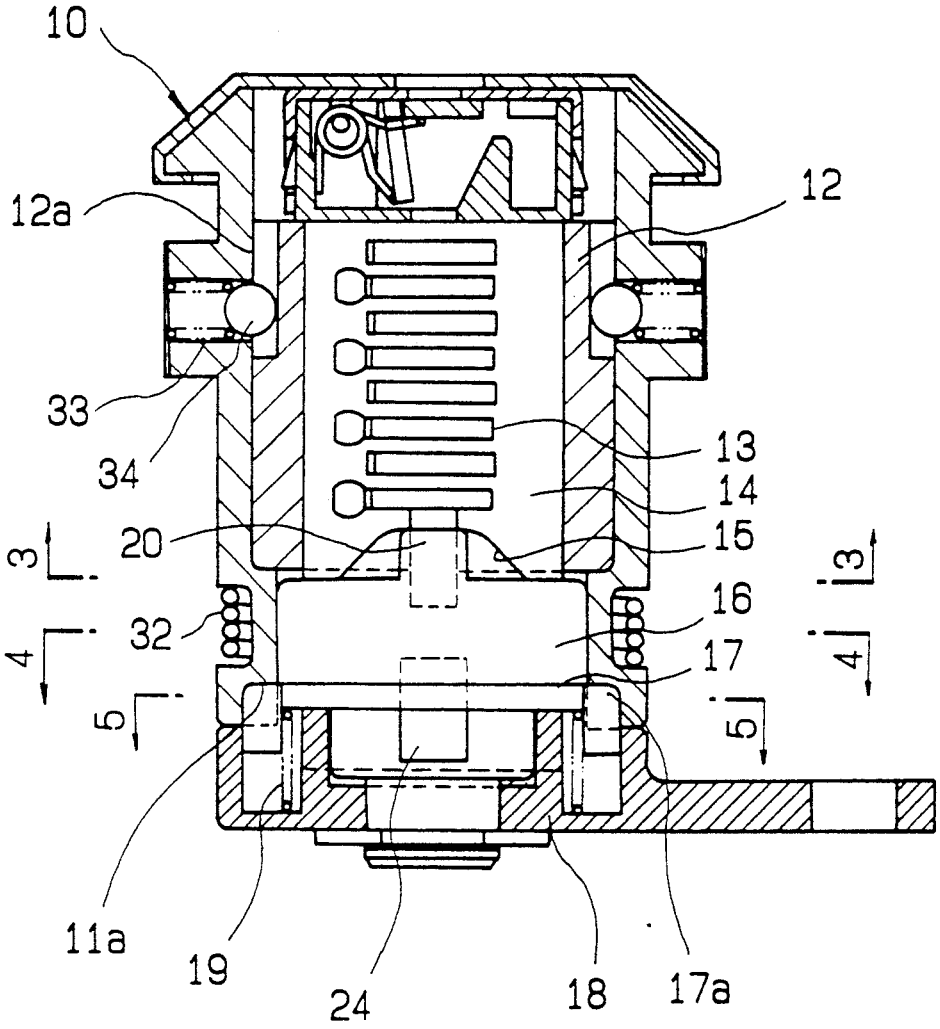
FIG. 2 is another cross-sectional view of the cylinder lock.
Figure 3:
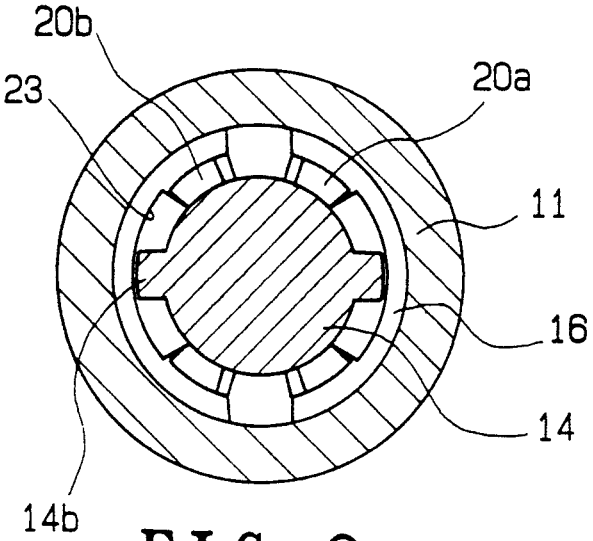
FIG. 3 is a cross-sectional view taken along line 3—3 of FIG. 2.
Figure 6:
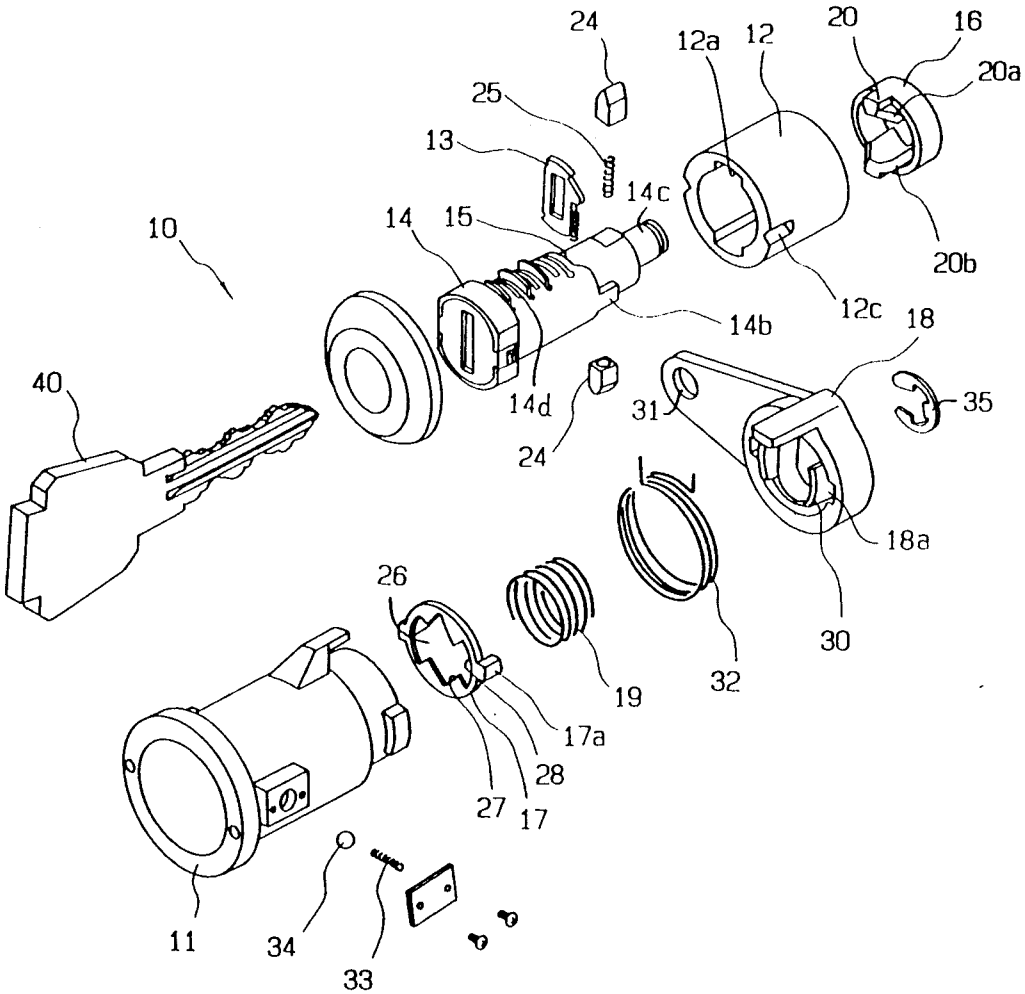
FIG. 6 is an exploded view of the cylinder lock.
Figure 7:
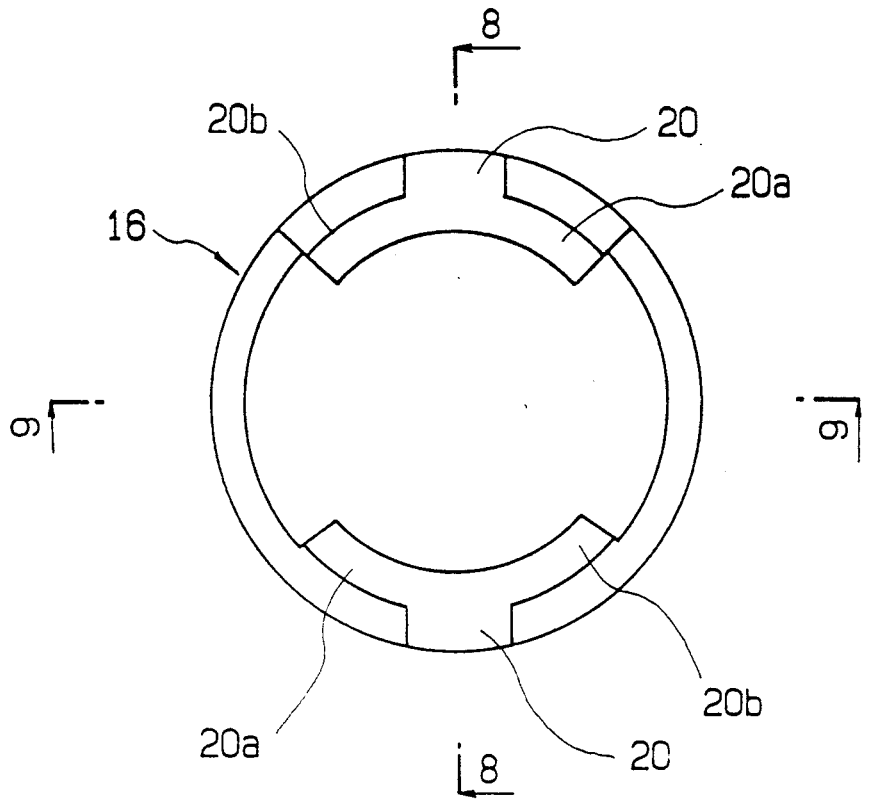
FIG. 7 is a plan view of the rotator.
Figure 8:
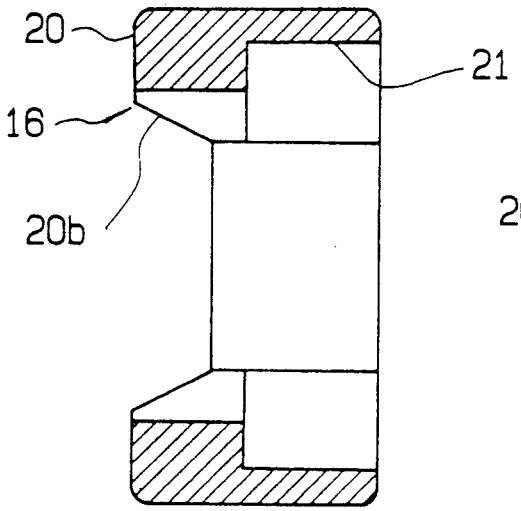
FIG. 8 is a cross-sectional view taken along line 8—8 of FIG. 7.
Figure 9:
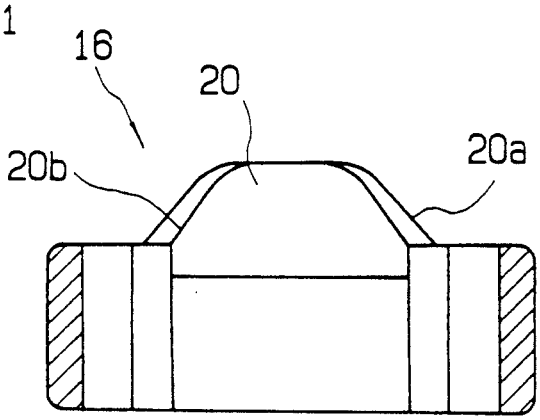
FIG. 9 is a cross-sectional view taken along line 9—9 of FIG. 7.
Figure 10:
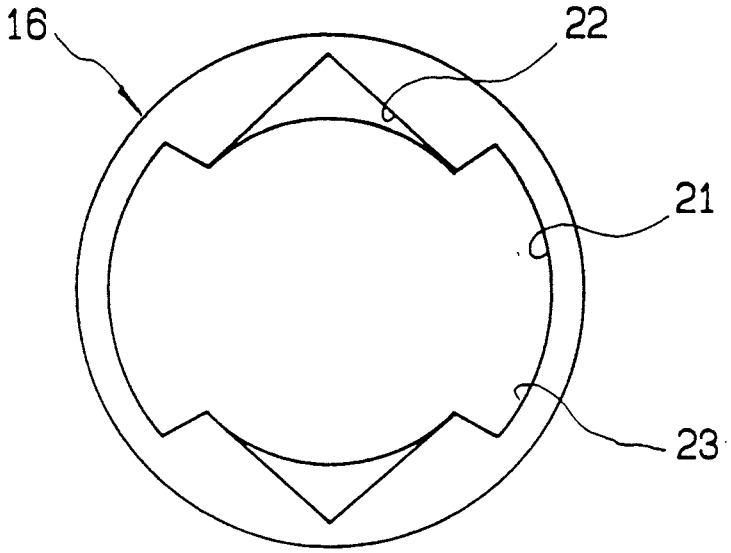
FIG. 10 is a bottom view of the rotator of the cylinder lock.
Figure 11:
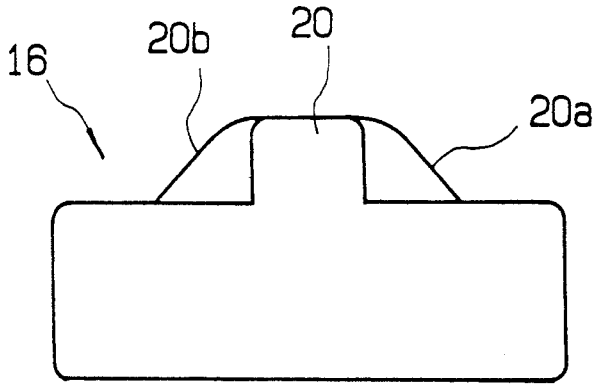
FIG. 11 is a side view of the rotator.
Figure 12:
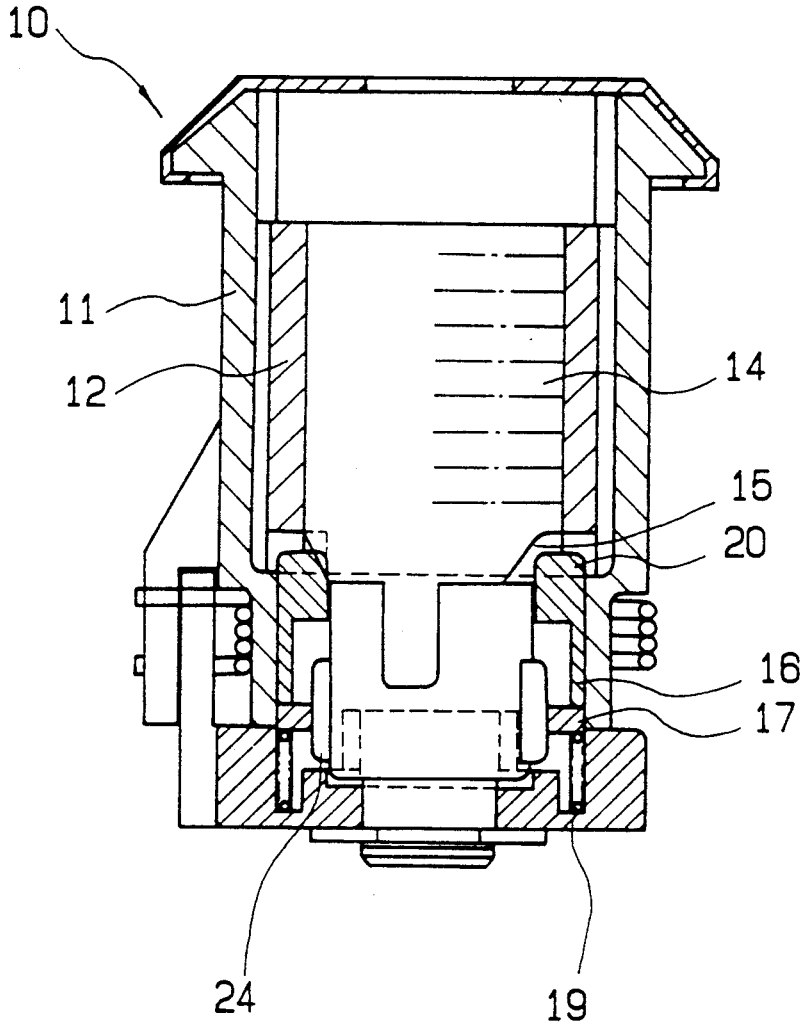
FIG. 12 is a cross-sectional view of the key cylinder rotated by a correct key to an angle of about 10°.
Figure 13:
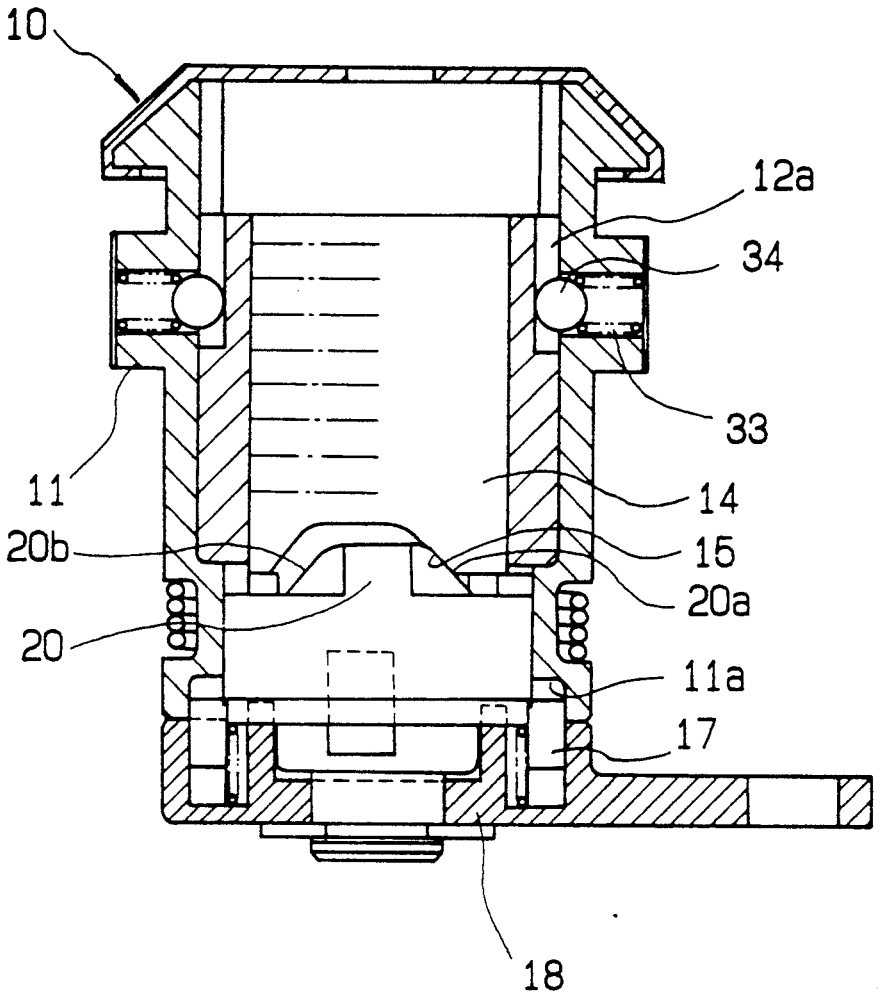
FIG. 13 is a cross-sectional view showing a rotated condition of FIG. 2.
Figure 14:
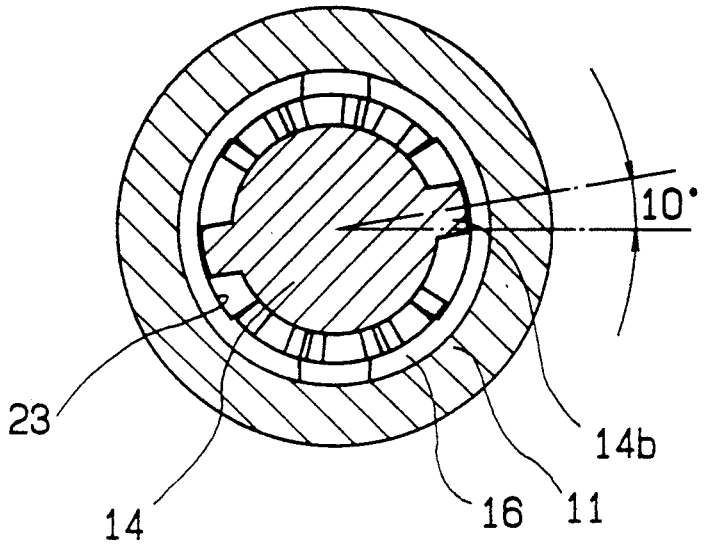
FIG. 14 is a cross-sectional view showing a rotated condition of FIG. 3.
Figure 15:
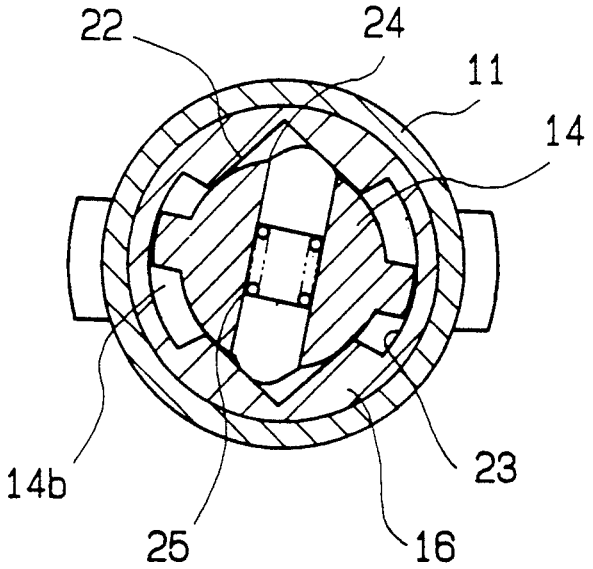
FIG. 15 is a cross-sectional view showing a rotated condition of FIG. 4.

As illustrated in FIGS. 1, 2 and 6, the cylinder lock 10 according to the present invention comprises a casing 11, a sleeve 12 rotatably disposed within the casing 11, and a key cylinder 14 rotatably positioned in the sleeve 12. As illustrated in FIG. 6, the key cylinder 14 has a plurality of tumblers 13 slidably disposed within slits **14*d* formed in the key cylinder 14 so that the tumblers 13 may protrude into and be engaged with opposite grooves 12*a* of the sleeve 12, and the key cylinder 14 is retained in engaged condition with the sleeve 12 by means of tumblers 13** in a well known manner.

Figure 4:
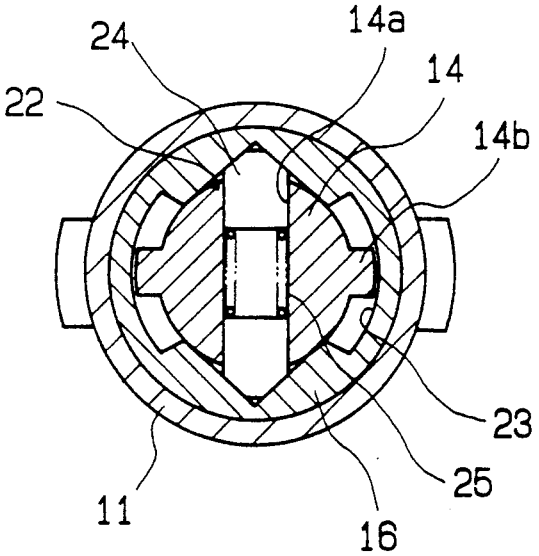
FIG. 4 is a cross-sectional view taken along line 4—4 of FIG. 2.
Figure 5:
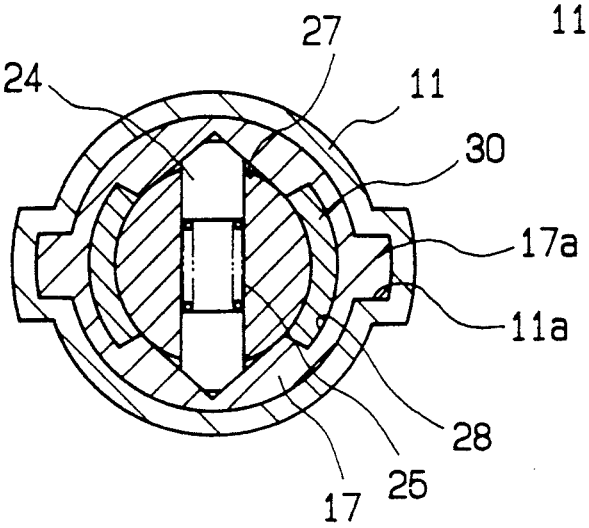
FIG. 5 is cross-sectional view taken along line 5—5 of FIG. 2.

As shown in FIG. 6, a rotator 16, a stopper 17 and a connector 18 are provided in alignment with the key cylinder 14. As indicated in FIG. 2, the key cylinder 14 is provided with a pair of axial cams 15 with which a pair of protrusions 20 of the rotator 16 may contact. The rotator 16 is also engaged with notches **12*b* of the sleeve 12. As exhibited by FIGS. 7 to 10, each of the protrusions 20 has a pair of inclined surfaces 20*a*, 20*b*, and a hole 21 is formed in an end of the rotator 16. The hole 21 is formed with radial cams 22 each having V-shaped inclined surfaces and a pair of arcuate notches 23. As shown in FIG. 4, the key cylinder 14 is provided with a radial hole 14*a* and a pair of projections 14*b* which are formed lengthwise of the key cylinder 14 and extend outwardly within the notches 23 of the rotator 16. A pair of pins 24 are slidably disposed within the hole 14*a* in which a radial spring 25 is positioned to resiliently urge each outer end of the pins 24 toward the radial cam 22**.

The stopper 17 is disposed adjacent to the rotator 16 and is provided with an opening 26 and a pair of lugs **17*a*. The opening 26 has its cross section substantially the same as that of the hole 21 of the rotator 16. The lugs 17*a* are engaged with recesses 11*a* of the casing 11 and recesses 18*a* of the connector 18. The opening 26 of the stopper 17 includes V-shaped inclined surfaces 27 to which the pins 24 are resiliently urged, and arcuate notches 28. The lugs 17*a* are slidably positioned within the recesses 11*a*. An axial spring 19 is placed between the stopper 17 and the connector 18 to elastically push the stopper 17 toward the rotator 16. A pair of arcuate arms 30 are formed on the connector 18 to always engage with the arcuate notches 28 of the stopper 17. The arms 30 of the connector 18 may be engaged with the notches 23 of the rotator 16 when the stopper 17 is axially moved. The connector 18** is formed with a hole 31 to which a rod (not shown) is connected for operation of a lock mechanism. A return spring 32 is located between the casing 11 and the connector 18. A V-shaped groove 12*c* formed on the sleeve 12, and a ball 34 is elastically urged on the groove 12*c* under elastic force of a spring 33. The connector 18 is rotatably attached to an inner end 14*c* of the key cylinder 14 for example by an E-ring 35.

Before a key 40 is inserted into the cylinder lock 10, the sleeve 12, key cylinder 14 and connector 18 are in the locked condition as shown in FIGS. 1 through 5. When a correct key is inserted into the key cylinder 14, the tumblers 13 are moved in the key cylinder 14 for disengagement from the sleeve 12, thus permitting key cylinder 14 to rotate independently of the sleeve 12. Then, when the key cylinder 14 is rotated to an angle of about 10°, the axial cams 15 of the key cylinder 14 come into engagement with the inclined surface 20*a* or 20*b* of the protrusions 20 of the rotator 16. At this time, the sleeve 12 is kept in a static condition by the spring 33 and ball 34, and the protrusions 20 of the rotator 16 are in engagement with the notches 12*b* of the fixed sleeve 12 so that the rotator 16 is axially and inwardly moved by the axial cams 15 of the rotating key cylinder 14. At the same time, the stopper 17 is axially and inwardly moved together with the rotator 16 against resilient force of the axial spring 19, while the pins 24 within the key cylinder 14 slide on the surfaces of the radial cams 22 of the rotator 16 against elastic force of the radial spring 25.

Figure 16:
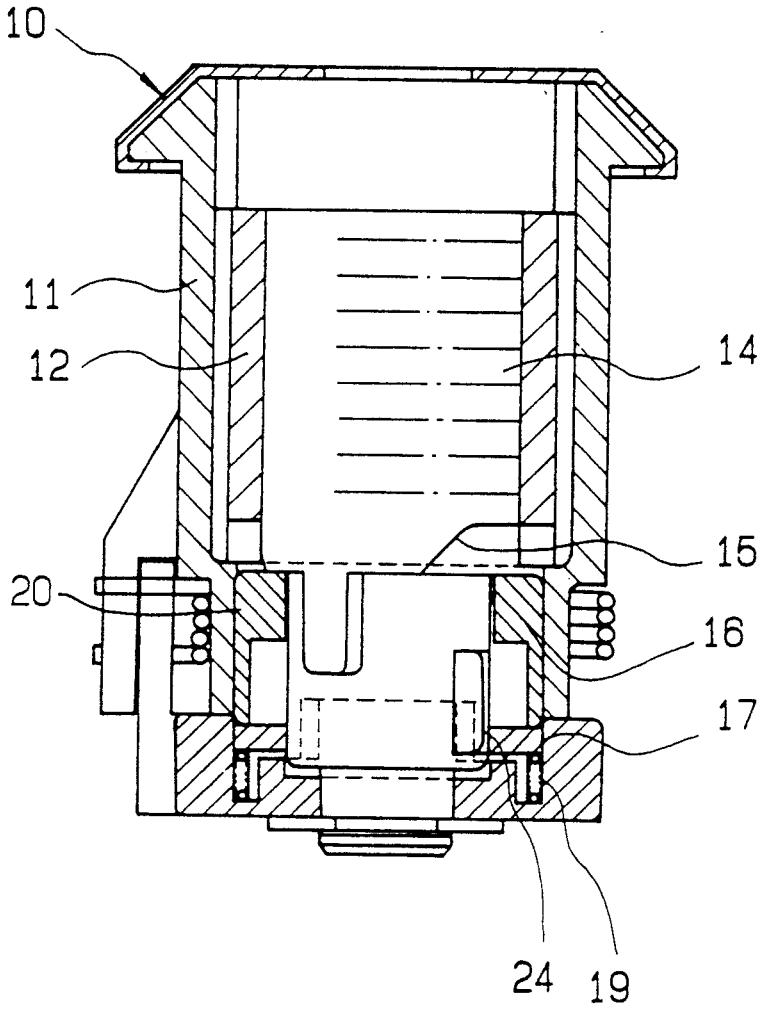
FIG. 16 is a cross-sectional view with the key cylinder rotated to an angle of about 30° by a correct key from the condition of FIG. 1.
Figure 17:
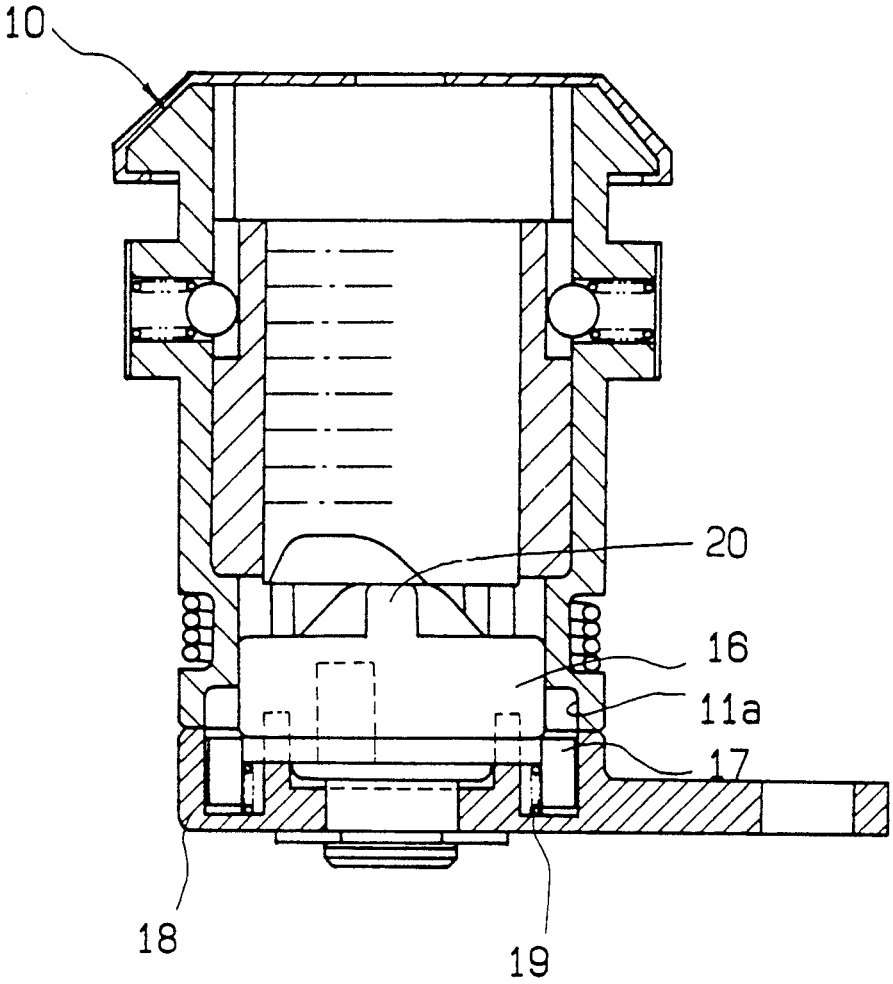
FIG. 17 is a cross-sectional view with the key cylinder rotated to an angle of about 30° from the condition of FIG. 2.
Figure 18:
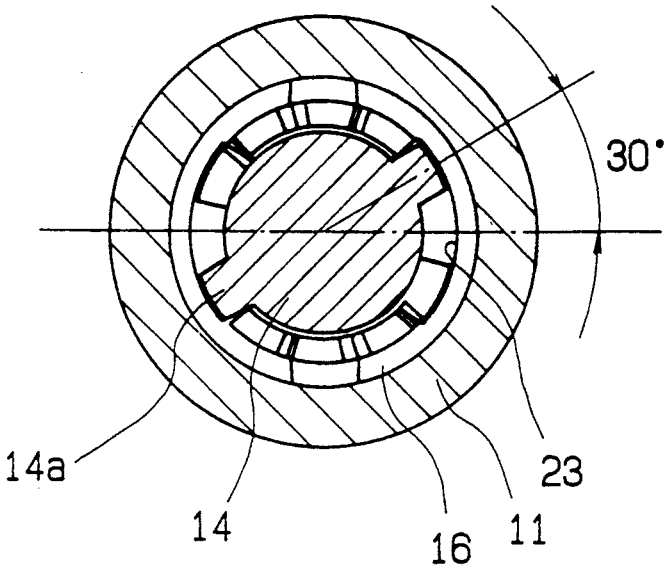
FIG. 18 is a cross-sectional view with the key cylinder rotated to an angle of about 30° from the condition of FIG. 3.
Figure 19:
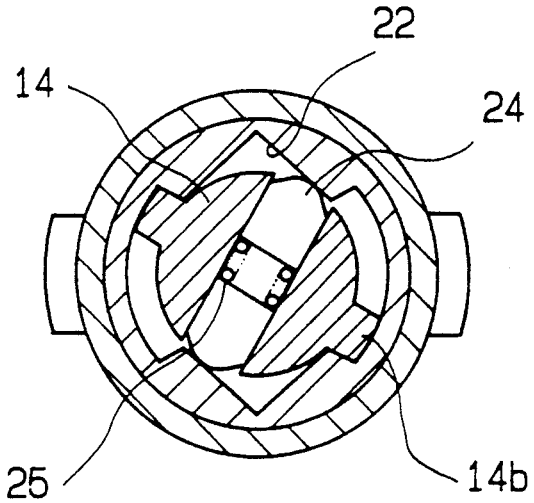
FIG. 19 is a cross-sectional view with the key cylinder rotated to an angle of about 30° from the condition of FIG. 4.
Figure 20:
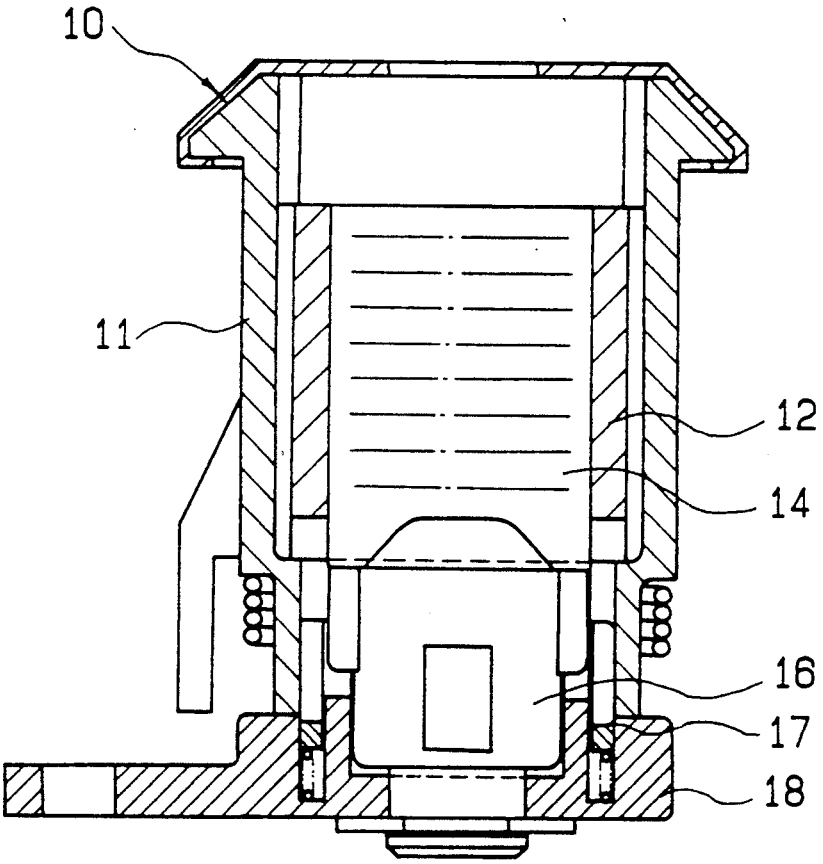
FIG. 20 is a cross-sectional view with the key cylinder rotated to an angle of about 90° by a correct key from the condition of FIG. 1.
Figure 21:
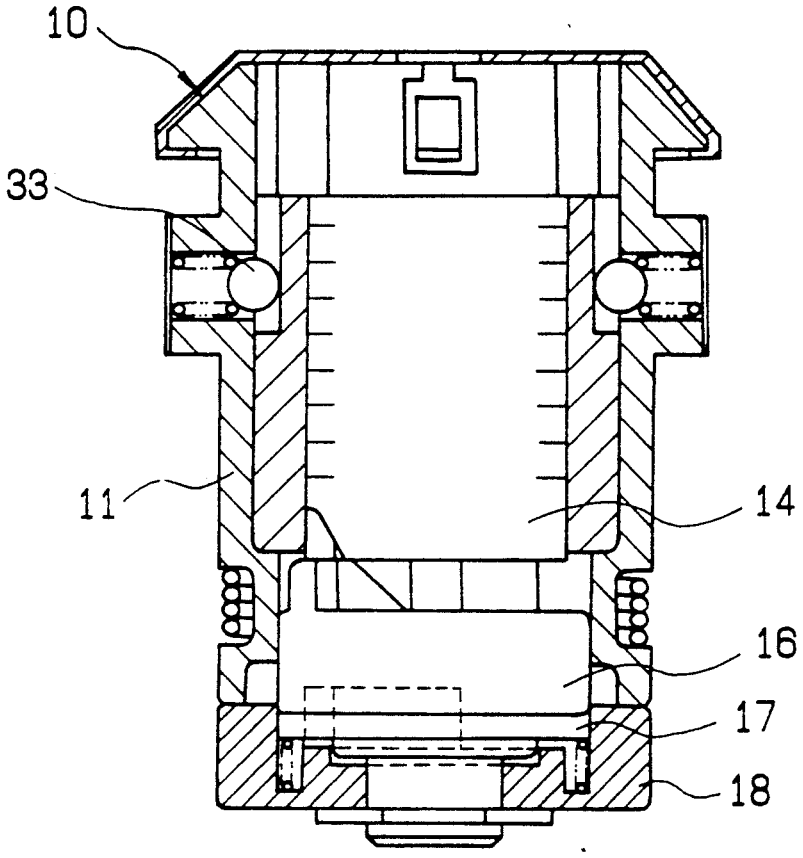
FIG. 21 is a cross-sectional view with the key cylinder rotated to an angle of about 90° from the condition of FIG. 2.
Figure 22:
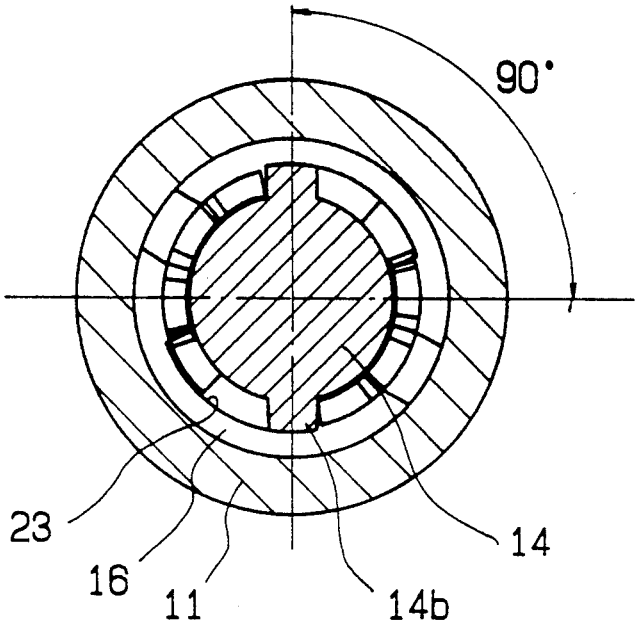
FIG. 22 is a cross-sectional view with the key cylinder rotated to an angle of about 90° from the condition of FIG. 3.

Subsequently, when the key cylinder 14 is rotated to an angle of about 30°, the rotator 16 is moved through a sufficient axial distance with rotation of the key cylinder 14. As illustrated in FIGS. 16 and 17, the protrusions 20 are moved away from the notches 12*b* of the sleeve 12. The arcuate arms 30 of the connector 18 which is engaged with the arcuate notch 28 of the stopper 17 is also brought into engagement with the notches 23 of the rotator 16. At that moment, the pins 24 of the key cylinder 14 are in contact with the inclined surfaces 27 of the stopper 17, and the lugs 17*a* of the stopper 17 are released from the recesses 11*a* of the casing 11. In other words, as shown in FIG. 18, the key cylinder 14 comes into engagement with the rotator 16 by contact of the projections 14*b* of the key cylinder 14 with each end of the arcuate notches 23 of the rotator 16. Also, the key cylinder 14 is engaged with the stopper 17 by contact of the pins 24 of the key cylinder 14 with the inclined surfaces 27 of the stopper 17.

When the key cylinder 14 is further rotated under the engaged condition with the rotator 16 and stopper 17, it is rotated with the rotator 16, stopper 17 and the connector 18 against resilient force of the return spring 32, thereby causing the connector 18 to move to a locked or unlocked position as shown in FIGS. 20 to 23.

If manual force is released from the key 40 in this condition, elastic force of the return spring 32 resiliently urges the connector 18, stopper 17 and rotator 16 to return them to their original positions in the reverse direction, and then elastic force of the radial spring 25 pushes the pins 24 toward the rotator 16 and stopper 17 and thereby serves to automatically return the key cylinder 14 to the original position. At the same time, the rotator 16 and stopper 17 are returned to the initial position shown in FIGS. 1 and 2 by resilient force of the axial spring 19.

Figure 23:
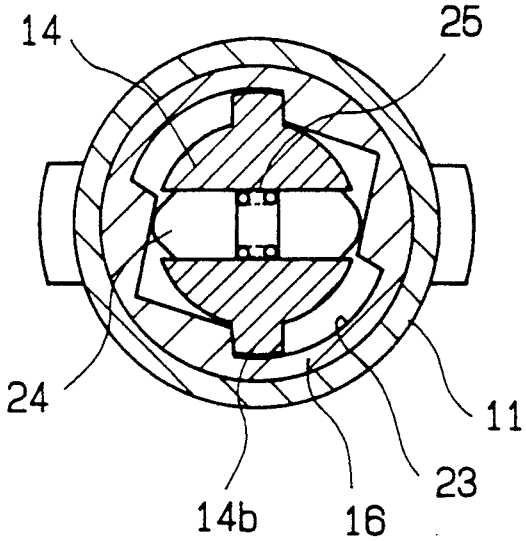
FIG. 23 is a cross-sectional view with the key cylinder rotated to an angle of about 90° from the condition of FIG. 4.
Figure 24:
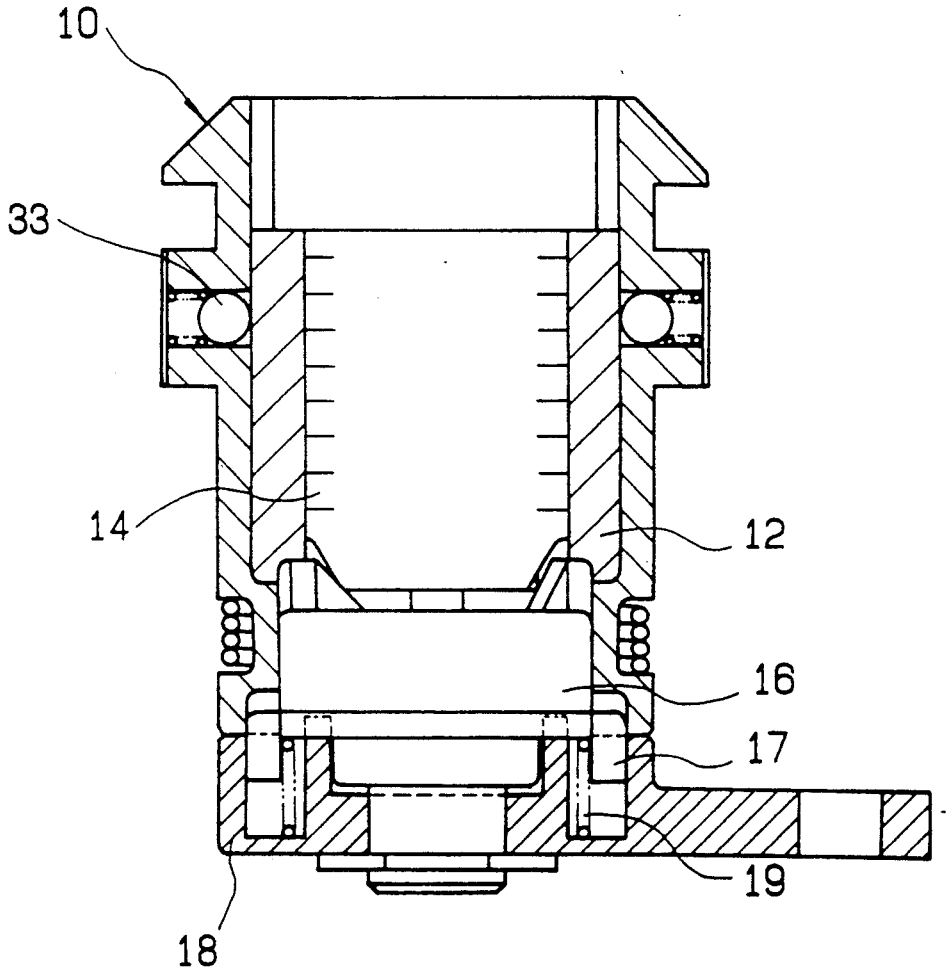
FIG. 24 is a cross-sectional view with the key cylinder by an incorrect key from FIG. 2.
Figure 25:
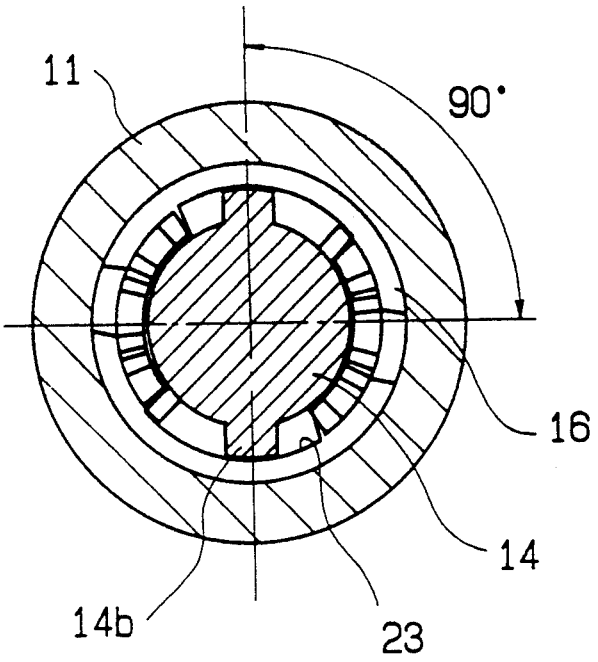
FIG. 25 is a cross-sectional view with the key cylinder by an incorrect key from FIG. 3.
Figure 26:
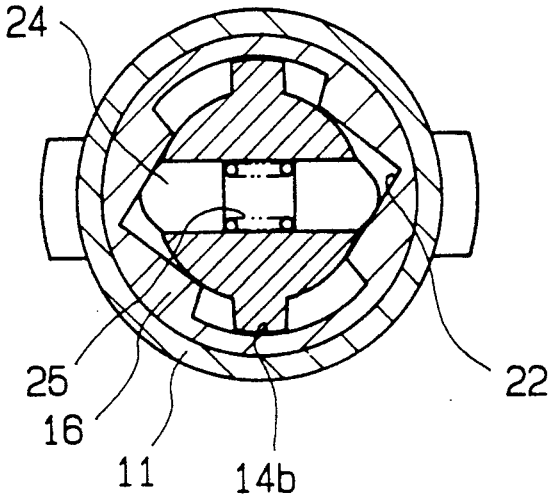
FIG. 26 is a cross-sectional view with the key cylinder by an incorrect key from FIG. 4.

On the other hand, if the key cylinder 14 is rotated by an incorrect key, the key cylinder 14 is retained in the engaged condition with the sleeve 12 by the tumblers 13. In other words, the key cylinder 14 will not come into engagement with the connector 18 via rotator 16, thus preventing rotation of the connector 18. Thus, due to no relative rotation of key cylinder 14 to the sleeve 12, the rotator 16 will not axially move independently of the sleeve 12. Accordingly, as illustrated in FIGS. 23 to 25, the ball 34 is moved out of the V-shaped groove 12*c* formed in the sleeve 12 against resilient force of the spring 33. Therefore, no excessive external force will be exerted on the tumblers 13, thus providing significant resistance to damage.

Figure 27:
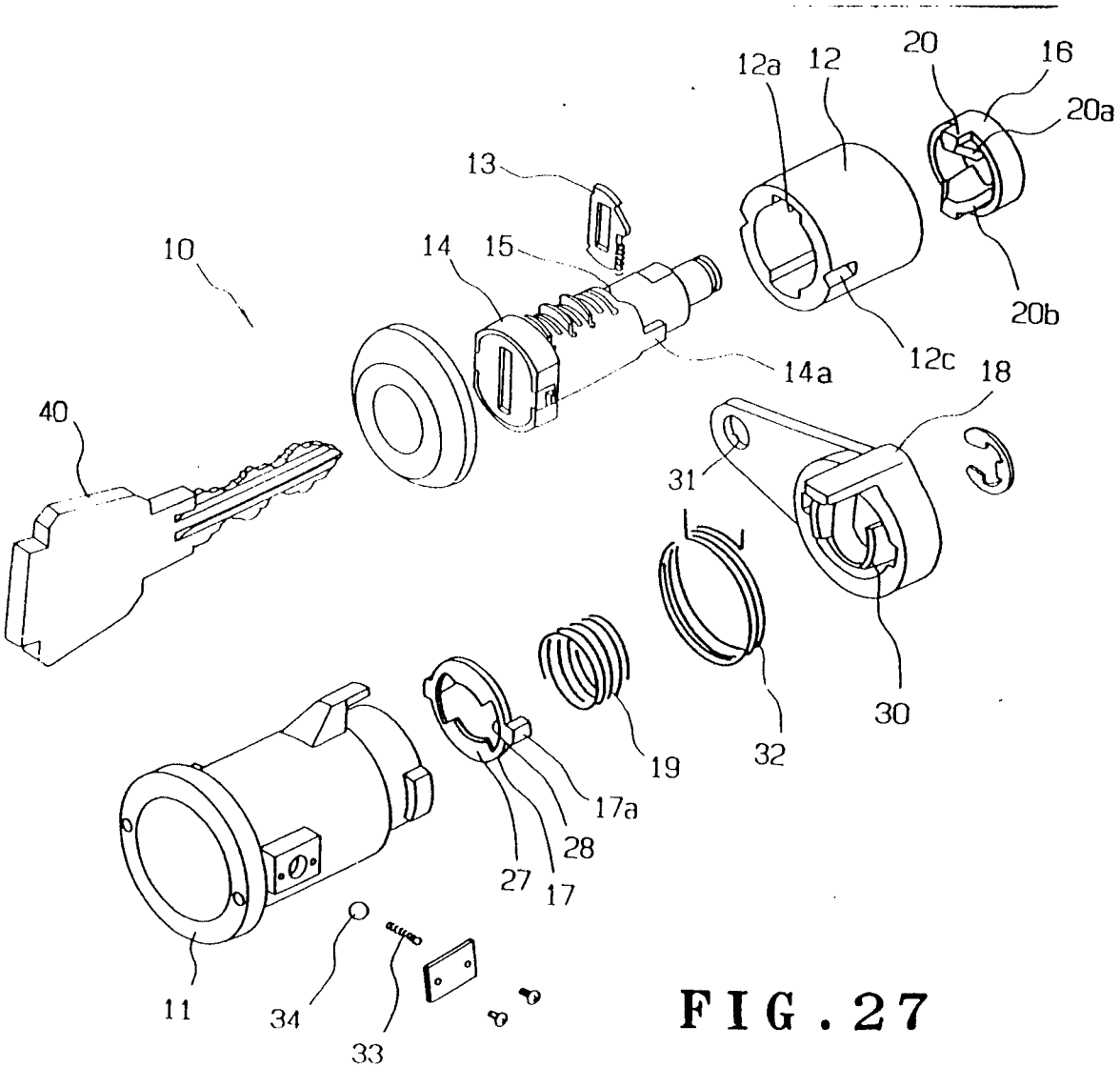
FIG. 27 illustrates an exploded view of another embodiment of the present invention.

In another embodiment of the present invention, as shown in FIG. 27, the pins 24 and the radial spring 25 may be omitted and the elastic force of the axial spring 19 resiliently urges the rotator 16 toward the axial cams 15 of the key cylinder 14 so that the key cylinder 14 and the rotator 16 may be returned to their original positions by virtue of the axial spring 19 without the pins 24 and the radial spring 25 when manual rotative force is released from the key 40.

The present invention is not limited to the aforedescribed embodiment but may be modified in various ways. For example, pin tumblers may be used in lieu of tumblers 13 of disk type in the above embodiment. In addition, the cams 15 may be formed in an additional member which can rotate together with key cylinder 14.

What is claimed is:

1. In a cylinder lock including a casing; a sleeve rotatably disposed in said casing; a key cylinder disposed rotatably within said sleeve; tumblers slidably disposed within slits formed in said key cylinder for engagement with the sleeve; and a connector drivingly connected to a lock device; the improvement comprising:

an axial cam and a radial projection each provided on the key cylinder;

a rotator being engageable with said sleeve having a protrusion in contact with said axial cam of the key cylinder;

said rotator being formed with an internal notch for receiving said projection of the key cylinder;

a stopper positioned adjacent to said rotator and having at least one lug engageable with a recess of said casing;

opposed spring pressed pins disposed radially within said key cylinder operable to engage radial cams formed on said rotator and on said stopper;

an axial spring positioned between said stopper and said connector for resiliently urging said stopper toward said rotator and into releasable engagement with said recess of said casing;

engagement means on said rotator and on said connector for making a driving connection therebetween;

said rotator normally in moveable engagement with said sleeve;

said stopper normally in moveable engagement with said casing;

the protrusion normally in moveable engagement with said axial cam; and said connector and said rotator normally out of engagement;

said key cylinder being releasable from said sleeve upon insertion of a proper key therein, whereby manual rotation of said key cylinder by means of a proper key operates to effect camming action between the axial cam and said protrusion to create axial motion effective to (a) release engagement of said rotator and said sleeve (b) release engagement of said stopper with said casing (c) operate the engagement means and (d) drive said radial spring pressed pins inwardly as the pins follow said radial cams of said rotator and said stopper whereby further rotation of the key cylinder causes the rotator, stopper and connector to move as a unit to operate a lock device; and return spring means operable upon release of said proper key for returning said rotator, said stopper and said connector to their original position whereby said spring pressed pins are free to move outwardly automatically so that camming action returns the key cylinder to its original position.

2. The cylinder lock of claim 1, wherein a pair of lugs are provided on the stopper for engaging the casing releasably and for making a driving connection between the stopper and the connector.

3. In a cylinder lock including a casing; a sleeve rotatably disposed in said casing; a key cylinder having a projection disposed rotatably within said sleeve; tumblers slidably disposed within slits formed in said key cylinder for engagement with the sleeve; and a connector drivingly connected to a lock device; the improvement comprising:

an axial cam and a projection each provided on the key cylinder;

a rotator engageable with said sleeve and in contact with said axial cam of the key cylinder, said rotator being formed with a radial cams and an internal arcuate notch for sliding engagement with said projection;

a stopper positioned adjacent to said rotator and having at least one lug engageable with a recess of said casing;

an axial spring positioned between said stopper and the connector for resiliently urging said stopper toward said rotator;

pin means radially and slidably positioned within said key cylinder for engagement with said radial cams formed on said rotator for returning said key cylinder to its initial position automatically a radial spring for resiliently urging said pin means toward said radial cams;

said rotator and stopper being axially moved by operation of said axial cam, said projection of said key cylinder and said notch of the rotator cooperating to block rotation of said rotator and stopper while releasing engagement of said rotator with said sleeve and releasing engagement of said stopper with said casing when said key cylinder is rotated independently of said sleeve by a correct key, thereby causing said rotator to engage said connector;

further rotation of the key cylinder causing said rotator, stopper and connector to rotate as a unit to a locked or unlocked position.

4. The cylinder lock of claim 3 further comprising a return spring disposed between said casing and connector.

5. The cylinder lock of claim 4 wherein the pin means defines a pair of opposed pins within said key cylinder.

* * * * *